US008971739B2

(12) United States Patent
Kinoshita

(10) Patent No.: US 8,971,739 B2
(45) Date of Patent: Mar. 3, 2015

(54) COLOR MISALIGNMENT CORRECTION PATTERN DETECTION METHOD IN IMAGE FORMING APPARATUS

(75) Inventor: Takeshi Kinoshita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 13/451,606

(22) Filed: Apr. 20, 2012

(65) Prior Publication Data

US 2012/0288289 A1 Nov. 15, 2012

(30) Foreign Application Priority Data

May 11, 2011 (JP) ..... 2011-106620

(51) Int. Cl.
*G03G 15/01* (2006.01)
*G03G 15/00* (2006.01)

(52) U.S. Cl.
CPC ..... *G03G 15/5058* (2013.01); *G03G 15/0189* (2013.01); *G03G 15/0131* (2013.01); *G03G 2215/0125* (2013.01); *G03G 2215/0161* (2013.01)
USPC ..... 399/49; 399/301

(58) Field of Classification Search
CPC ..... G03G 15/5058; G03G 2215/0161
USPC ..... 399/49, 301
See application file for complete search history.

(56) References Cited

U.S. PATENT DOCUMENTS

2008/0292369 A1* 11/2008 Takezawa ..... 399/301
2010/0008686 A1* 1/2010 Masuda et al. ..... 399/51
2011/0058823 A1* 3/2011 Hirai ..... 399/15

FOREIGN PATENT DOCUMENTS

JP 2003-177578 A 6/2003

* cited by examiner

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

A pattern detection sensor includes a light emitting element for specular reflection, a light emitting element for diffuse reflection light, and a light receiving element. When turning on the light emitting element for specular reflection to emit light, a light source switching unit keeps off the light emitting element for diffuse reflection light. When turning on the light emitting element for diffuse reflection light to emit light, the light source switching unit keeps off the light emitting element for specular reflection. An offset detection unit detects a difference between a detection timing by specular reflection light and another detection timing by diffuse reflection light as an offset value (mutual detection error).

9 Claims, 10 Drawing Sheets

COLOR MISALIGNMENT CORRECTION PATTERN DETECTION METHOD IN IMAGE FORMING APPARATUS

BACKGROUND OF THE INVENTION

1. Field of the Invention

The present invention relates to an image forming apparatus including a detection unit which detects a formed pattern.

2. Description of the Related Art

Multicolor image forming apparatuses which form a multicolor image by superimposing a plurality of colors (for example, yellow, magenta, cyan, and black) are becoming popular. The multicolor image forming apparatus forms a multicolor image by superimposing a plurality of colors. If the image forming positions of the respective colors shift from ideal positions, the image quality degrades. To reduce the image forming positional error, color misalignment correction patterns are formed by image forming units of the respective colors and read to compute the color misalignment amounts of the respective colors. The image forming positions are then corrected in accordance with the computed color misalignment amounts.

The correction pattern can be detected by an optical sensor or the like arranged near an intermediate transfer member. More specifically, the pattern is recognized by irradiating the intermediate transfer member with light emitted by a light emitting element, and detecting a difference between the quantity of light reflected by the surface of the intermediate transfer member and that of light reflected by the correction pattern formed on the intermediate transfer member. Japanese Patent Laid-Open No. 2003-177578 proposes a specular reflection light detection method as a method of detecting reflection light.

Repetitive image formation changes the surface state of the intermediate transfer member, decreasing the gloss. This is because the surface of the intermediate transfer member wears upon cleaning of toner left on the surface of the intermediate transfer member and rubbing of the intermediate transfer member with an intermediate transfer mechanism (transfer device). If the quantity of specular reflection light from the surface of the intermediate transfer member changes, the difference between the quantity of specular reflection light from the surface of the intermediate transfer member and that of specular reflection light from the correction pattern transferred onto the intermediate transfer member cannot be detected.

The inventor considered a method of irradiating a correction pattern with light from two light sources and detecting the specular reflection light and diffuse reflection light by one light receiving unit as a method of detecting a correction pattern on a poor-gloss intermediate transfer member. However, this method has a problem in which if the optical axis of the specular reflection light emitting unit and that of the diffuse reflection light emitting unit deviate from desired design values, a mutual detection error is generated. The mutual detection error is a difference between the time when light emitted by the specular reflection light emitting unit reaches the light receiving unit and the time when light emitted by the diffuse reflection light emitting unit reaches the light receiving unit. The mutual detection error changes the correction pattern detection result from an original detection result, finally decreasing the color misalignment correction precision. To suppress the decrease in color misalignment correction precision, the difference (mutual detection error) between the correction pattern detection timing by specular reflection light and that by diffuse reflection light needs to be specified.

SUMMARY OF THE INVENTION

According to the present invention, the first and second light emitting units are alternatively turned on to acquire the timing when specular reflection light from a pattern was detected and the timing when diffuse reflection light from the pattern was detected. The difference (mutual detection error) between the correction pattern detection timing by specular reflection light and that by diffuse reflection light can be specified.

The present invention provides an image forming apparatus comprising the following units. A plurality of image forming units is configured to form images of different colors. A detection unit is configured to detect patterns formed by the plurality of image forming units. The detection unit includes a light receiving unit, a first light emitting unit located such that the light receiving unit receives specular reflection light, and a second light emitting unit located such that the light receiving unit receives diffuse reflection light. An emission control unit is configured to alternatively control the first light emitting unit and the second light emitting unit to emit light. A specifying unit is configured to specify a difference between a detection timing when the detection unit detects a pattern based on light arising from the first light emitting unit, and a detection timing when the detection unit detects a pattern based on light arising from the second light emitting unit. A color misalignment correction unit is configured to correct misalignment between color images to be formed by the plurality of image forming units in response to the specified difference and the detection results of the patterns formed by the plurality of image forming units.

Further features of the present invention will become apparent from the following description of exemplary embodiments (with reference to the attached drawings).

DESCRIPTION OF THE EMBODIMENTS

An embodiment of the present invention will now be described in detail by way of example with reference to the accompanying drawings. The sizes, materials, shapes, and relative arrangements of constituent components described in the following embodiment are not intended to limit the scope of the invention, unless otherwise specified.

Figure 1:
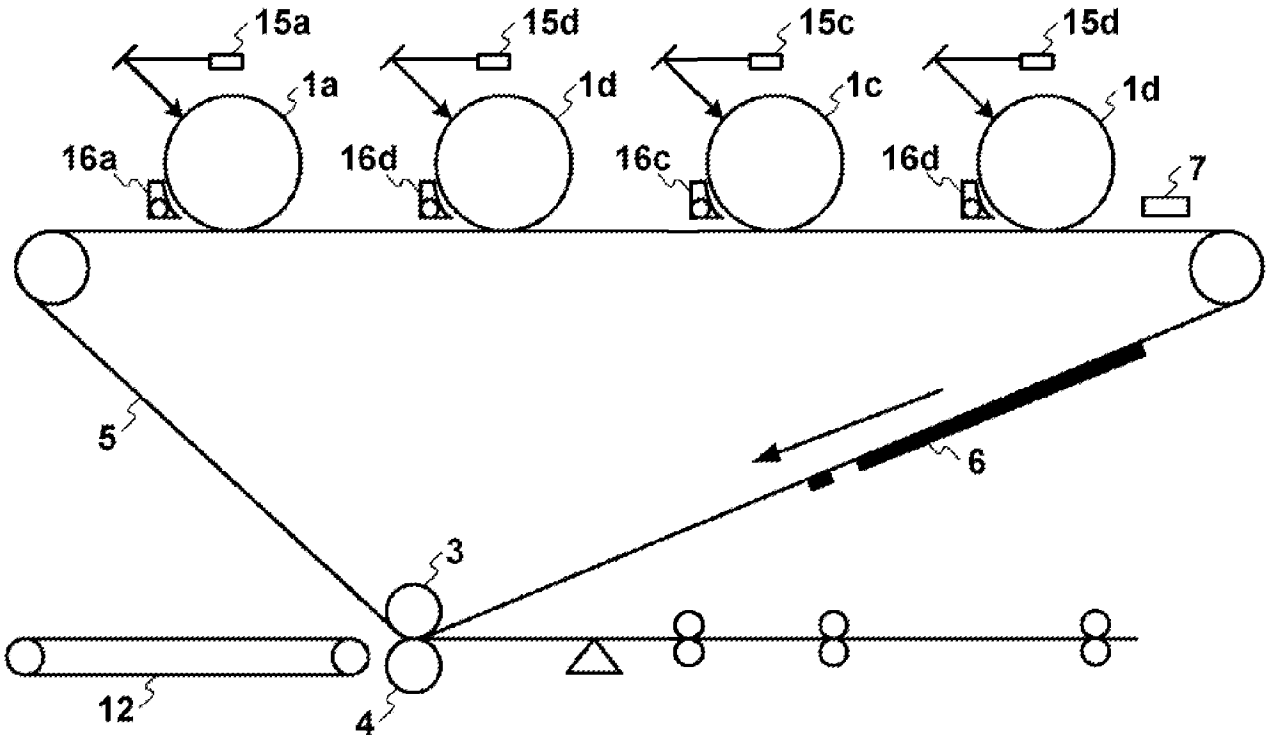
FIG. 1 is a schematic view for explaining the arrangement of an image forming apparatus.

Referring to FIG. 1, image forming stations which function as image forming units are arranged in the order of yellow (Y), cyan (C), magenta (M), and black (K). Exposure devices 15*a*, 15*b*, 15*c*, and 15*d* expose uniformly charged photosensitive drums 1*a*, 1*b*, 1*c*, and 1*d*, forming latent images. Developing units 16*a*, 16*b*, 16*c*, and 16*d* develop the respective latent images, forming toner images. The toner images formed on the photosensitive drums 1*a*, 1*b*, 1*c*, and 1*d* are sequentially transferred onto the surface of an intermediate transfer belt 5 to overlap each other. As a result, a multicolor toner image 6 is formed. The toner image 6 is transferred onto paper at a contact portion (transfer position) between a belt support roller 3 and a transfer roller 4. A conveyance belt 12 conveys the paper to a fixing unit (not shown). The fixing unit fixes the toner image onto the paper. Note that the photosensitive drums 1*a*, 1*b*, 1*c*, and 1*d* are examples of image carriers, and the intermediate transfer belt 5 is an example of an intermediate transfer member.

As shown in FIG. 1, a pattern detection sensor 7 is arranged near the surface of the intermediate transfer belt 5. The pattern detection sensor 7 reads the color misalignment correction pattern of each color formed on the surface of the intermediate transfer belt 5 or the surface itself (that is, background) of the intermediate transfer belt 5. The correction pattern reading result represents the misalignment amount of the image forming position of each color. The image forming position is adjusted in accordance with the misalignment amount, reducing the color misalignment. The image forming positions are adjusted by adjusting the write start timings of the exposure devices 15*a*, 15*b*, 15*c*, and 15*d*.

Figure 2:
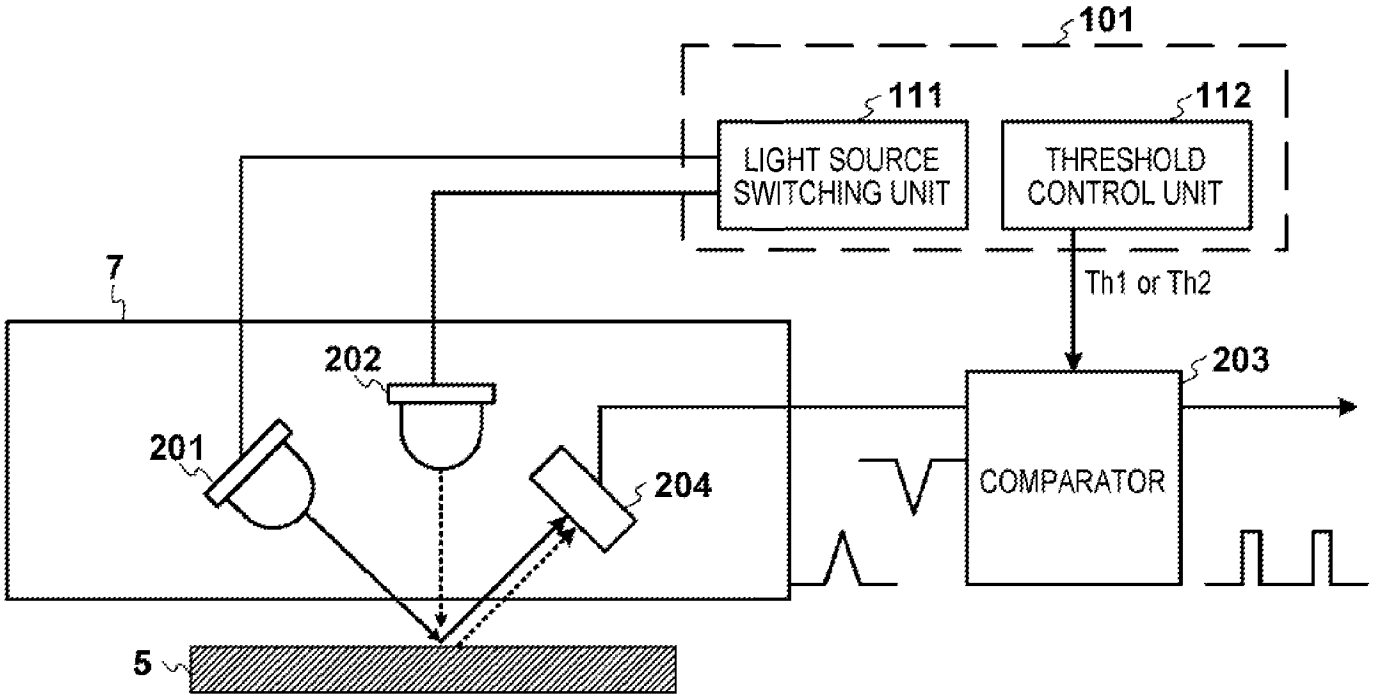
FIG. 2 is a view showing the optical relationship between a light emitting element for specular reflection, a light emitting element for diffuse reflection light, and a light receiving element.

The arrangement of the pattern detection sensor 7 will be exemplified with reference to FIG. 2. The pattern detection sensor 7 functions as a detection unit configured to detect a pattern image (to be referred to as a pattern) of each color formed by the image forming station. A light emitting element for specular reflection 201 functions as the first light emitting unit configured to irradiate a pattern or the background of the intermediate transfer member with light. A light emitting element for diffuse reflection light 202 functions as the second light emitting unit configured to irradiate a pattern or the background of the intermediate transfer member with light when the light emitting element for specular reflection 201 is OFF. A light receiving element 204 functions as a light receiving unit configured to receive specular reflection light obtained by reflecting, by a pattern, light emitted by the light emitting element for specular reflection 201, and diffuse reflection light obtained by reflecting, by a pattern, light emitted by the light emitting element for diffuse reflection light 202. An ASIC 101 includes a light source switching unit 111 and threshold control unit 112. The light source switching unit 111 functions as an emission control unit configured to alternatively control the light emitting element for specular reflection 201 and light emitting element for diffuse reflection light 202 to emit light. The threshold control unit 112 functions as a threshold selection unit configured to select the first threshold when the light emitting element for specular reflection 201 emits light, and select the second threshold when the light emitting element for diffuse reflection light 202 emits light. A comparator 203 functions as a signal generation unit configured to compare the level of a signal output from the light receiving element 204 with a threshold selected by the threshold control unit 112, and generate a signal serving as the comparison result.

Light emitted by the light emitting element for specular reflection 201 is reflected by the background of the intermediate transfer belt 5 or a toner image formed on the intermediate transfer belt 5, and the light receiving element 204 receives specular reflection light. The light emitting element for specular reflection 201 and light receiving element 204 are arranged so that the incident angle and reflection angle of light become equal to each other. Of the light emitted by the light emitting element for diffuse reflection light 202, diffuse reflection light reflected by the background of the intermediate transfer belt 5 or the toner image formed on the intermediate transfer belt 5 enters the light receiving element 204. The light emitting element for diffuse reflection light 202 is arranged so that the incident angle and reflection angle of light emitted by the light emitting element for diffuse reflection light 202 with respect to the intermediate transfer belt 5 do not become equal to each other.

The optical axis of the light emitting element for specular reflection 201 and that of the light emitting element for diffuse reflection light 202 are adjusted in accordance with design values in assembly of the pattern detection sensor 7, but vary owing to an instrumental error. Owing to optical axis deviation, the detection timing of the light emitting element for specular reflection 201 and that of the light emitting element for diffuse reflection light 202 do not match each other, decreasing the color misalignment correction precision.

Figure 3:
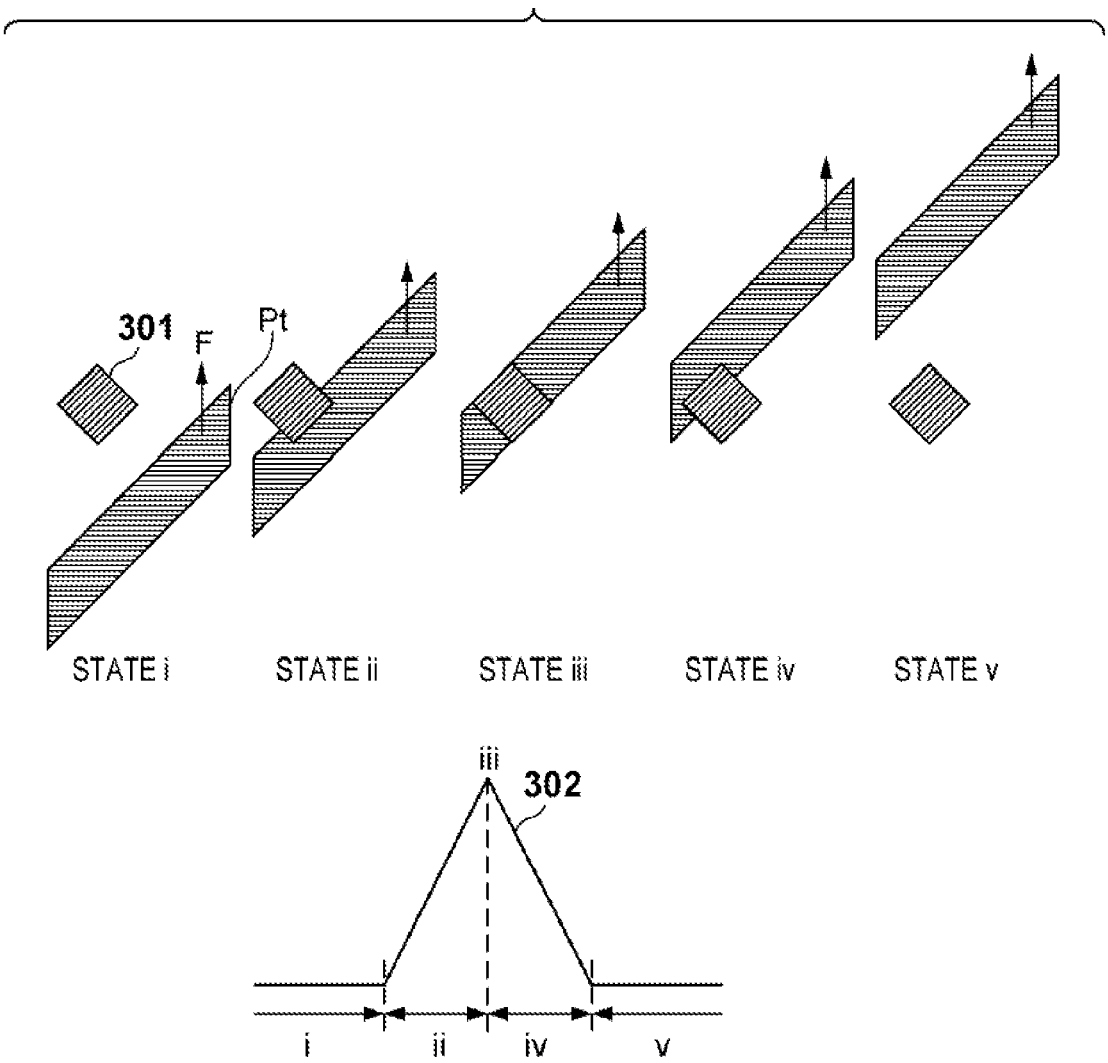
FIG. 3 is a view showing the relationship between the pattern position and the output waveform of the light receiving element.

The relationship between a YMC correction pattern Pt formed on the surface of the intermediate transfer belt 5, a detection region 301 of the light receiving element 204, and an output signal 302 serving as a diffuse reflection light detection result output from the pattern detection sensor 7 will be explained with reference to FIG. 3. In FIG. 3, state i, state ii, state iii, state iv, and state v are aligned time-sequentially. An arrow F in FIG. 3 indicates the conveyance direction of the intermediate transfer belt 5.

As shown in FIG. 3, the level of the output signal 302 is proportional to an area by which the correction pattern Pt overlaps the detection region 301 of the light receiving element 204. In the first state and final state v, the area is 0, and the level of the output signal 302 is lowest. In state ii, the area increases in proportion to time, and the level of the output signal 302 also rises in proportion to time. In step iii, the area maximizes, and the level of the output signal 302 also becomes highest. In state iv, the area decreases in proportion to time, and the level of the output signal 302 also drops in proportion to time.

FIG. 3 shows the relationship between the YMC correction pattern and an output result serving as a diffuse reflection light detection result. However, even for the K correction pattern or an output signal serving as a specular reflection light detection result, the level of the output signal changes depending on the area.

Figure 4A:
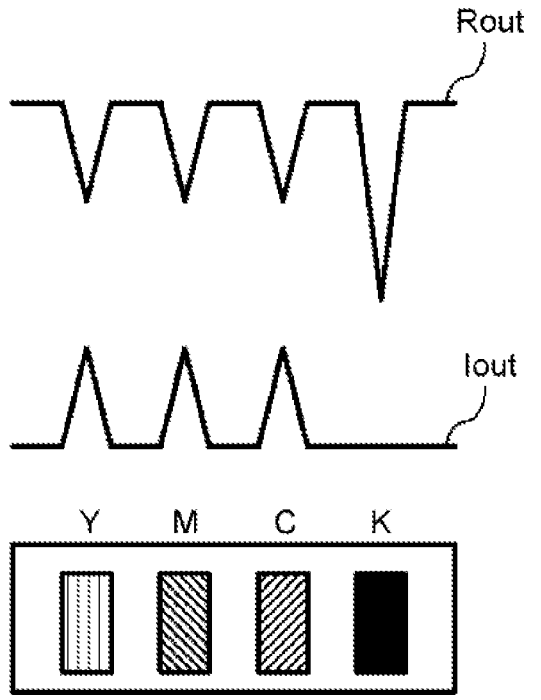
FIG. 4A is a view showing the output level of the light receiving element for Y, M, C, and K patterns before an intermediate transfer belt wears.

FIG. 4A shows the output level Rout of the light receiving element 204 for specular reflection light and the output level Iout for diffuse reflection light in a state in which the gloss of the surface of the intermediate transfer belt 5 is high. The high gloss state is a state in which the intermediate transfer belt 5 does not so wear.

As the intermediate transfer belt 5, the embodiment assumes a black glossy polyimide sheet. The specular reflection component of reflection light of light which has irradiated the background of the intermediate transfer belt 5 is large in specular reflection light, so the output level Rout becomes high. When yellow, magenta, cyan, and black toner images of a pattern or the like are formed on the surface of the intermediate transfer belt 5, the specular reflection component decreases and the output level Rout drops.

Since the intermediate transfer belt 5 is black, the diffused component of reflection light of light which has irradiated the background of the intermediate transfer belt 5 is small, and the output level Iout becomes low. When yellow, magenta, and cyan toner images of a pattern or the like are formed on the surface of the intermediate transfer belt 5, the diffused component increases and the output level Rout rises. The diffused component is small in reflection light from the black pattern, so the output level Iout becomes low. That is, the output level Iout obtained upon reading the black pattern becomes almost equal to the output level Iout obtained upon reading the background of the intermediate transfer belt 5.

In the high gloss state, black, yellow, magenta, and cyan toner images can be detected from the output level Rout of specular reflection light, and yellow, magenta, and cyan toner images can be detected from the output level Iout of diffuse reflection light.

Figure 4B:
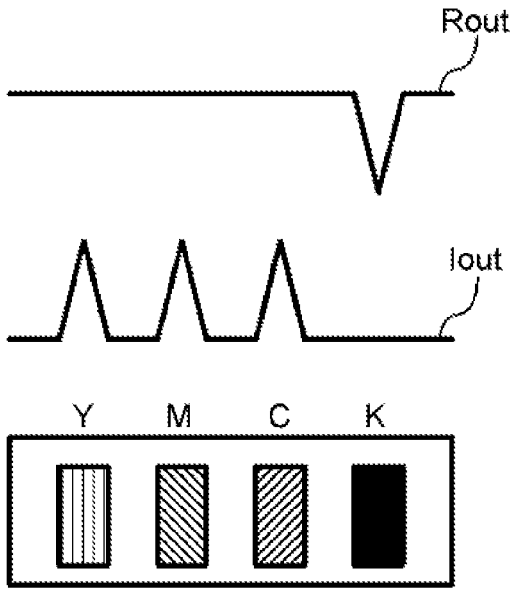
FIG. 4B is a view showing the output level of the light receiving element for Y, M, C, and K patterns after the intermediate transfer belt wears.

FIG. 4B shows the output level Rout of the light receiving element 204 for specular reflection light and the output level Iout for diffuse reflection light in a state in which the gloss of the surface of the intermediate transfer belt 5 is low. The low gloss state is a state in which the intermediate transfer belt 5 wears greatly.

If the gloss decreases, the specular reflection component of reflection light of light which has irradiated the background of the intermediate transfer belt 5 decreases. As a result, the output level Rout in the low gloss state becomes lower than the output level Rout in the high gloss state. As shown in FIG. 4B, the output level Rout of the background of the intermediate transfer belt 5 becomes almost equal to the output level Rout of yellow, magenta, and cyan toner images. Even if the gloss of the intermediate transfer belt 5 decreases, the output level Rout of specular reflection light from the black pattern (black toner image) becomes lower than the output level Rout of specular reflection light from the background of the intermediate transfer belt 5.

The output level Iout of diffuse reflection light from the background of the intermediate transfer belt 5 and yellow, magenta, cyan, and black toner images hardly changes between the high gloss state and the low gloss state.

In this way, a black toner image can be detected using the output level Rout of specular reflection light regardless of the gloss state. Yellow, magenta, and cyan toner images can be detected from the output level Iout of diffuse reflection light. By detecting specular reflection light and diffuse reflection light, all black, yellow, magenta, and cyan toner images can be detected regardless of the gloss state.

However, for the pattern detection sensor 7 shown in FIG. 2, the detection timing of the light emitting element for specular reflection 201 and that of light emitting element for the diffuse reflection light 202 need to match each other. To make the detection timings match each other, a toner image needs to be detected from both specular reflection light and diffuse reflection light for one arbitrary color.

The difference (mutual detection error) between a correction pattern detection timing by specular reflection light and a correction pattern detection timing by diffuse reflection light will be described with reference to FIG. 5. Here, the analog output level Rout and digital output level Rout_d of specular reflection light, and the analog output level Iout and digital output level Iout_d of diffuse reflection light upon detecting the correction pattern Pt will be explained.

When the optical axis does not deviate in diffused reflection detection, the analog output level Iout of diffuse reflection light upon detecting the correction pattern Pt is free from any waveform distortion. The analog output level Iout of diffuse reflection light is binarized based on a predetermined threshold Th2, obtaining the digital output level Iout_d.

Figure 5:
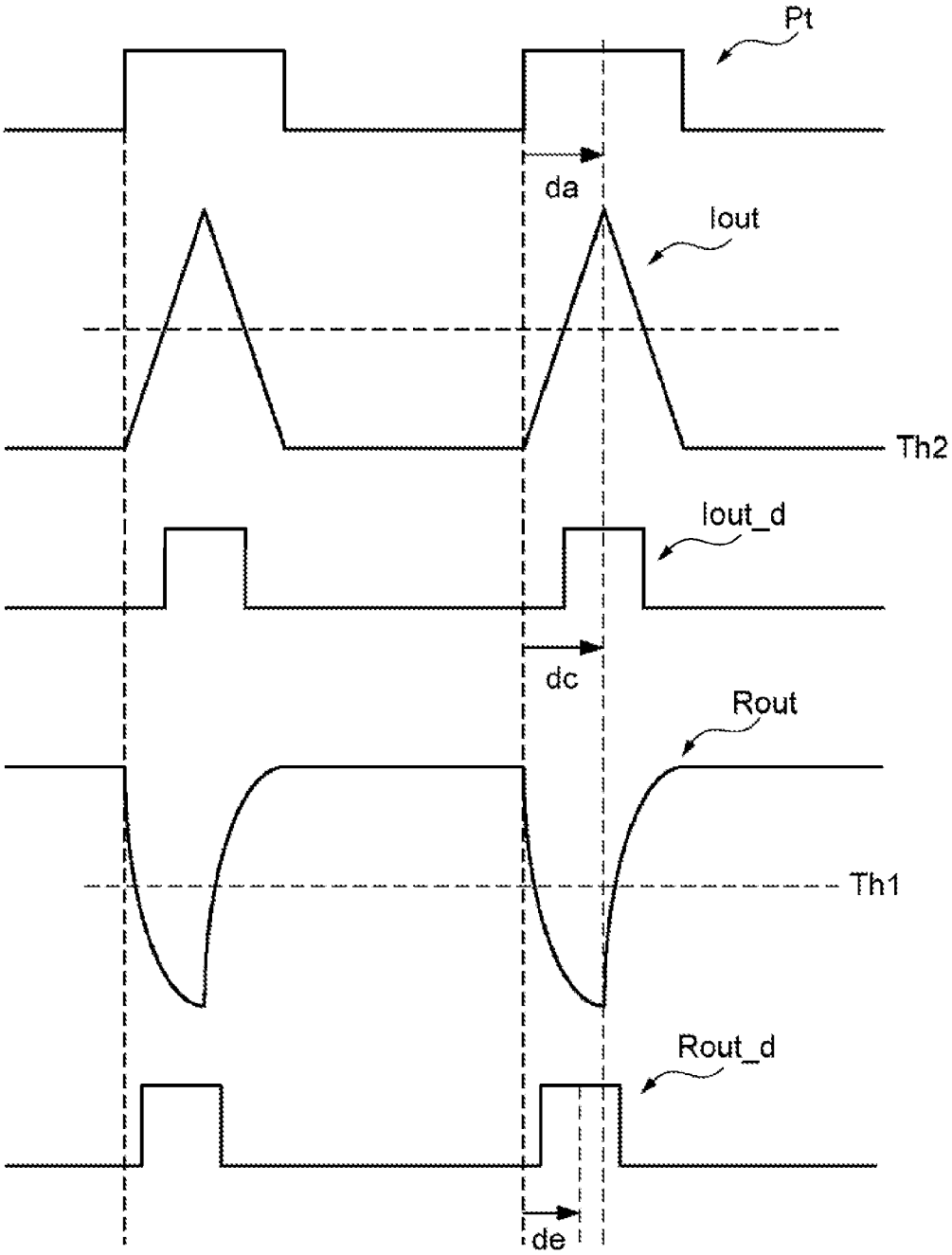
FIG. 5 is a waveform chart showing an output waveform in the absence of optical axis deviation and an output waveform in the presence of optical axis deviation.

When the optical axis deviates in specular reflection detection, the analog output level Rout of specular reflection light upon detecting the correction pattern Pt has a distorted waveform, as shown in FIG. 5. The analog output level Rout of specular reflection light is binarized based on a predetermined threshold Th1, obtaining the digital output level Rout_d.

If no optical axis deviates, the center of the correction pattern Pt coincides with that of the pulse waveform of the digital output level Iout_d of diffuse reflection light. That is, the time da from the leading edge to center of the correction pattern Pt coincides with the time dc from the leading edge to center of the digital output level Iout_d of diffuse reflection light. Although not shown in FIG. 5, these centers also coincide with the center of the pulse waveform of the digital output level Rout_d of specular reflection light. However, if the optical axis deviates, the center of the correction pattern Pt does not coincide with that of the pulse waveform of the digital output level Rout_d of specular reflection light. That is, the time da from the leading edge to center of the correction pattern Pt does not coincide with the time de from the leading edge to center of the digital output level Rout_d of specular reflection light. The difference between dc and de corresponds to a detection timing shift.

Figure 6:
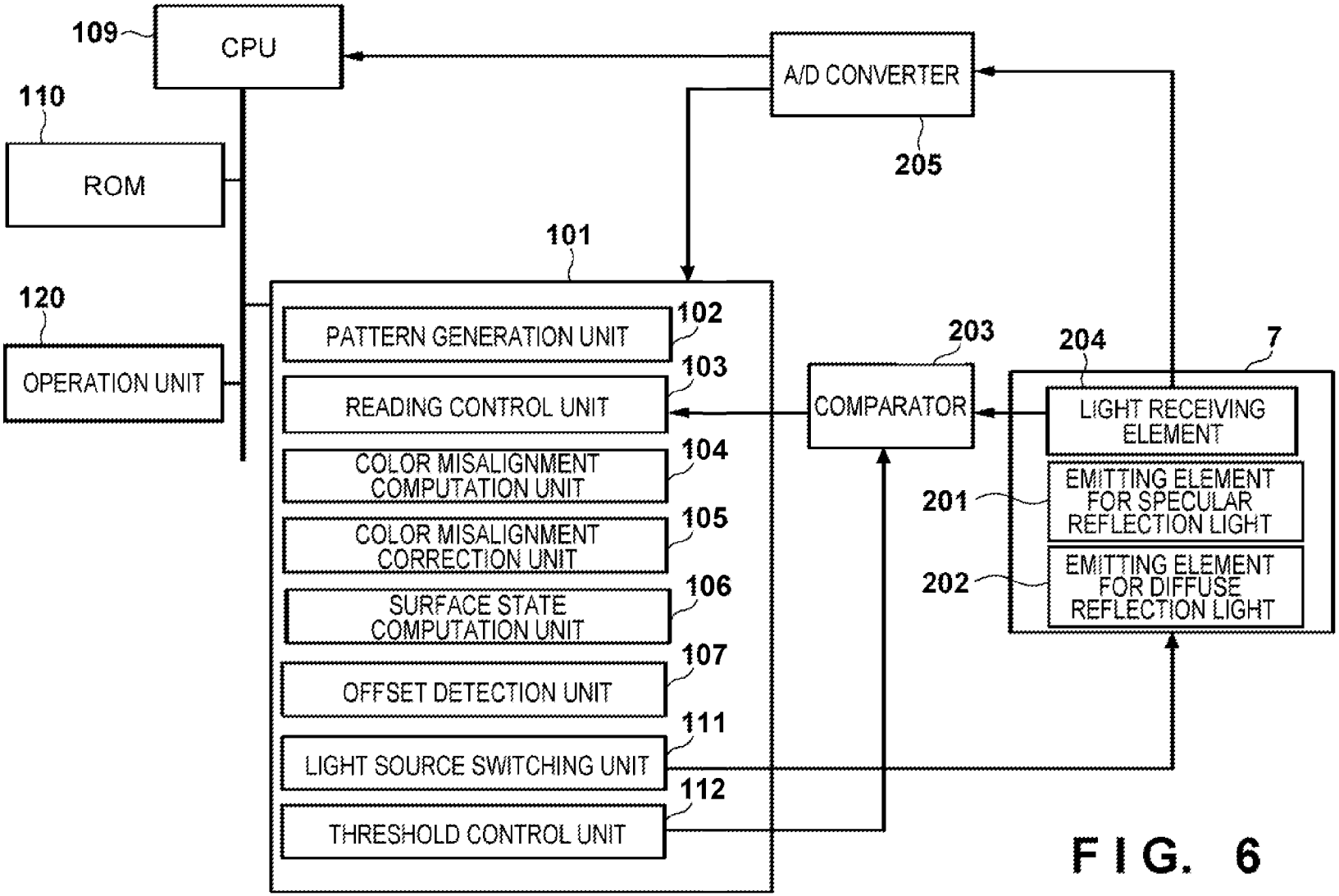
FIG. 6 is a block diagram showing a control unit.

The arrangement of a control system according to the embodiment will be explained with reference to FIG. 6. A CPU 109 is the center of the control system, and controls various instructions. The CPU 109 functions as various units by executing programs stored in a ROM 110. An operation unit 120 includes an input device for inputting information and instructions, and a display device for outputting information.

The light receiving element 204 of the pattern detection sensor 7 outputs a voltage corresponding to the light reception quantity of reflection light from the surface (background) of the intermediate transfer belt 5 or a toner image formed on the intermediate transfer belt 5. An output voltage signal from the light receiving element 204 upon receiving specular reflection light is input to the comparator 203 in which the first threshold Th1 is set. An output voltage signal from the light receiving element 204 upon receiving diffuse reflection light is input to the comparator 203 in which the second threshold Th2 is set. The comparator 203 outputs a digital signal binarized based on the first threshold Th1 or second threshold Th2. An analog output voltage signal from the light receiving element 204 is also input to an A/D converter 205. The A/D converter 205 converts the analog output voltage signal into a digital output signal, and outputs the digital output signal to the CPU 109.

The ASIC 101 is a digital integrated circuit and has various functions. A pattern generation unit 102 generates image data of a pattern, and outputs it to the exposure device. A reading control unit 103 reads a digital output signal from the comparator 203, and temporarily stores the data. A color misalignment computation unit 104 computes a misalignment of each color based on the data held in the reading control unit 103. In general, the time difference between the detection timing of a reference color (for example, black pattern) and that of another color except for the reference color should be a fixed value. This is because the distances between Y, M, C, and K patterns are fixed, as shown in FIGS. 4A and 4B. Hence, the difference between the time difference between the detection timing of the reference color (for example, black pattern) and that of another color except for the reference color, and the design fixed value is computed as a color misalignment amount.

A color misalignment correction unit 105 adjusts the write start timing in accordance with the time corresponding to the color misalignment amount computed by the color misalignment computation unit 104. A surface state computation unit 106 computes the surface glossiness (gloss level) of the intermediate transfer belt 5 from the light reception quantity of reflection light from the surface of the intermediate transfer belt 5. The surface state computation unit 106 may use a mathematical expression representing the relationship between the light reception quantity and the surface glossiness, or a table representing this relationship. The CPU 109 compares the surface glossiness computed by the surface state computation unit 106 with a threshold. If the surface glossiness exceeds the threshold, the CPU 109 determines that the intermediate transfer belt 5 need not be replaced, and if the surface glossiness does not exceed the threshold, determines that the intermediate transfer belt 5 needs to be replaced.

An offset detection unit 107 computes a difference between the timing when the light receiving element 204 has detected specular reflection light based on light emitted by the light emitting element for specular reflection 201, and the timing when the light receiving element 204 has detected diffuse reflection light based on light emitted by the light emitting element for diffuse reflection light 202. Further, the offset detection unit 107 holds the difference as a detection timing shift (offset value). The offset detection unit 107 functions as a specifying unit configured to specify a difference between a pattern detection timing by specular reflection light and a pattern detection timing by diffuse reflection light, from a signal generated by the comparator 203 in accordance with the comparison between the level of a signal output when the light receiving element 204 receives specular reflection light and the first threshold, and a signal generated by the comparator 203 in accordance with the comparison between the level of a signal output when the light receiving element 204 receives diffuse reflection light and the second threshold.

The light source switching unit 111 alternatively selects and turns on and off the light emitting element for specular reflection 201 and light emitting element for diffuse reflection light 202. The threshold control unit 112 selects the first threshold Th1 and sets it in the comparator 203 when the light emitting element for specular reflection 201 emits light. The threshold control unit 112 selects the second threshold Th2 and sets it in the comparator 203 when the light emitting element for diffuse reflection light 202 emits light.

The relationship between the output level Iout of a voltage signal output when the light receiving element 204 receives diffuse reflection light, and the output level Iout_d of an output signal from the comparator 203 will be explained with reference to FIG. 7A. As shown in FIG. 3, the waveform of the output level Iout of diffused reflection of a toner image in the absence of optical axis deviation is triangular. The comparator 203 outputs an output level Iout_d corresponding to "1" when the output level I_out exceeds the second threshold Th2, and an output level Iout_d corresponding to "0" when it does not exceed the second threshold Th2.

The relationship between the output level Rout when the light receiving element 204 receives specular reflection light from a toner image in the absence of optical axis deviation, and the output level Rout_d of an output signal from the comparator 203 will be explained with reference to FIG. 7B. As shown in FIG. 7B, the comparator 203 outputs an output level Rout_d corresponding to "1" when the output level Rout becomes lower than the first threshold Th1, and an output level Rout_d corresponding to "0" when it does not become lower than the first threshold Th1.

A method of computing an offset between the timing when the light receiving element 204 has detected specular reflection light based on light emitted by the light emitting element for specular reflection 201 and the timing when the light receiving element 204 has detected diffuse reflection light based on light emitted by the light emitting element for diffuse reflection light 202 will be described with reference to FIG. 8. Color misalignment correction is performed using a relative amount between the timing when a pattern has been detected from specular reflection light and the timing when a pattern has been detected from diffuse reflection light. In this case, if optical axis deviation occurs as shown in FIG. 5, the color misalignment correction precision decreases. This is because no accurate color misalignment amount can be detected. To prevent this, the shift amount between a detection timing by specular reflection light and a detection timing by diffuse reflection light, which arises from optical axis deviation or the like, is held as an offset value. When computing a relative amount, the offset value is added to modify the relative amount. As a result, the relative amount comes close to an accurate value, and the color misalignment correction precision hardly decreases.

Figure 8:
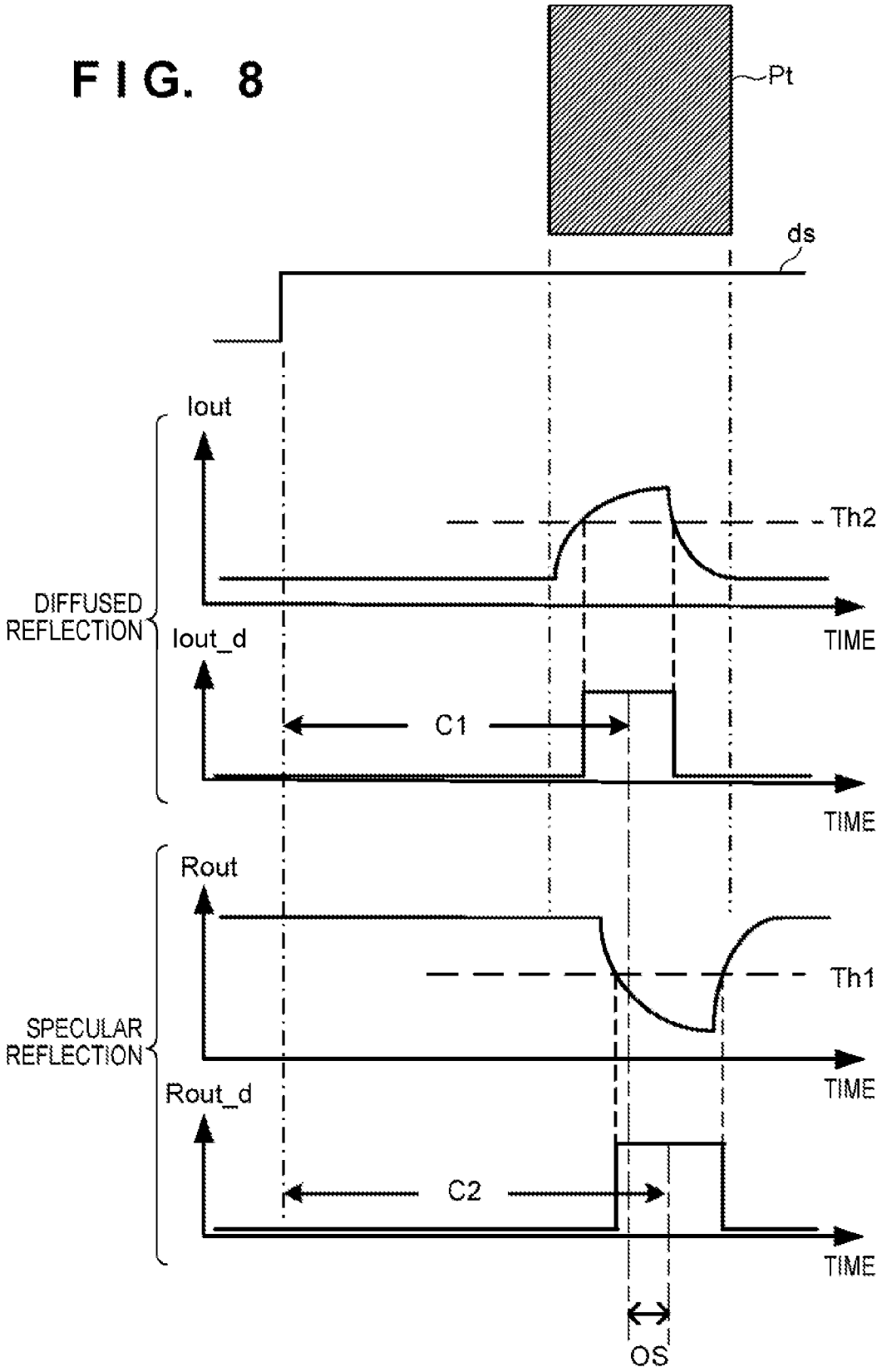
FIG. 8 is a timing chart showing a detection timing offset value between two light emitting elements.

As shown in FIG. 8, the light source switching unit 111 outputs a lighting signal ds to the light emitting element for diffuse reflection light 202, and the offset detection unit 107 starts a counter (or timer). The offset detection unit 107 specifies the center of the pulse of the output level Iout_d from pattern reading data held in the reading control unit 103. Further, the offset detection unit 107 acquires, from the counter, a count value C1 from the timing when the lighting signal ds has been enabled, to the center of the pulse.

Similarly, the light source switching unit 111 turns off the light emitting element for diffuse reflection light 202, and outputs the lighting signal ds to the light emitting element for specular reflection 201. When the lighting signal ds is enabled, the offset detection unit 107 starts the counter (or timer). The offset detection unit 107 specifies the center of the pulse of the output level Rout_d from pattern reading data held in the reading control unit 103. Also, the offset detection unit 107 acquires, from the counter, a count value C2 from the timing when the lighting signal ds has been enabled, to the center of the pulse. Finally, the offset detection unit 107 computes a difference between C1 and C2 as an offset value os.

A sequence in a main body operation according to the present invention will be explained with reference to FIGS. 9A through 9C. The timing when the positional relationship between the pattern detection sensor 7 and the intermediate transfer belt 5 changes is the timing when the optical axis deviation amounts of specular reflection light and diffuse reflection light changes. For example, the following timings (maintenance conditions) are assumed:

1. the main body of the image forming apparatus has been just assembled;
2. the main body of the image forming apparatus has been just installed;

3. the intermediate transfer belt 5 has been just replaced; and
4. the pattern detection sensor 7 has been just replaced.

The operator or maintenance person performs these work operations. The operator or maintenance person operates the operation unit 120 to log in to the maintenance mode of the CPU 109, obtains an offset value, and corrects a color misalignment amount. As shown in FIG. 8, the detection timing shift between specular reflection light and diffuse reflection light for the same pattern is measured. For this purpose, the surface glossiness of the intermediate transfer belt 5 needs to have a value large enough "to be able to ensure the output level difference between a pattern and the background of the intermediate transfer belt 5 so that the pattern can be accurately recognized from specular reflection light".

In step S900, the CPU 109 determines whether information input from the input device of the operation unit 120 has satisfied the maintenance condition. The CPU 109 displays, on the display device of the operation unit 120, a message which inquires whether the main body has been just assembled or installed, the intermediate transfer belt has been just replaced, or the sensor has been just replaced. If an input which satisfies the maintenance condition is executed on the operation unit 120, the CPU 109 advances to step S901; if no maintenance condition is satisfied, to step S906.

In step S901, the CPU 109 logs in to the maintenance mode. In step S902, the CPU 109 determines, using the surface state computation unit 106 in accordance with the maintenance mode, whether the gloss of the surface is lower than a predetermined reference value. If the gloss computed by the surface state computation unit 106 has not exceeded the reference value, the process advances to step S903. In step S5903, the CPU 109 displays, on the display device of the operation unit, an alarm message which prompts replacement of the intermediate transfer belt 5. Then, the process advances to step S905. If the gloss has exceeded the reference value, the process advances to step S904. In step S904, the CPU 109 executes offset value computation processing (FIG. 9B) in accordance with the maintenance mode. If the offset detection unit 107 and CPU 109 determine in step S902 that the gloss value of the surface of the intermediate transfer member on which a pattern is formed has exceeded the reference value, the offset detection unit 107 specifies a detection timing difference in step S904. After the end of computing the offset value, the process advances to step S905. In step S905, the CPU 109 logs out from the maintenance mode.

In step S906, the CPU 109 shifts to the print standby state. In step S907, the CPU 109 determines whether a print job has been received. If the CPU 109 determines that no print job has been received, the process returns to step S906; if it determines that a print job has been received, to step S908.

Figure 9A:
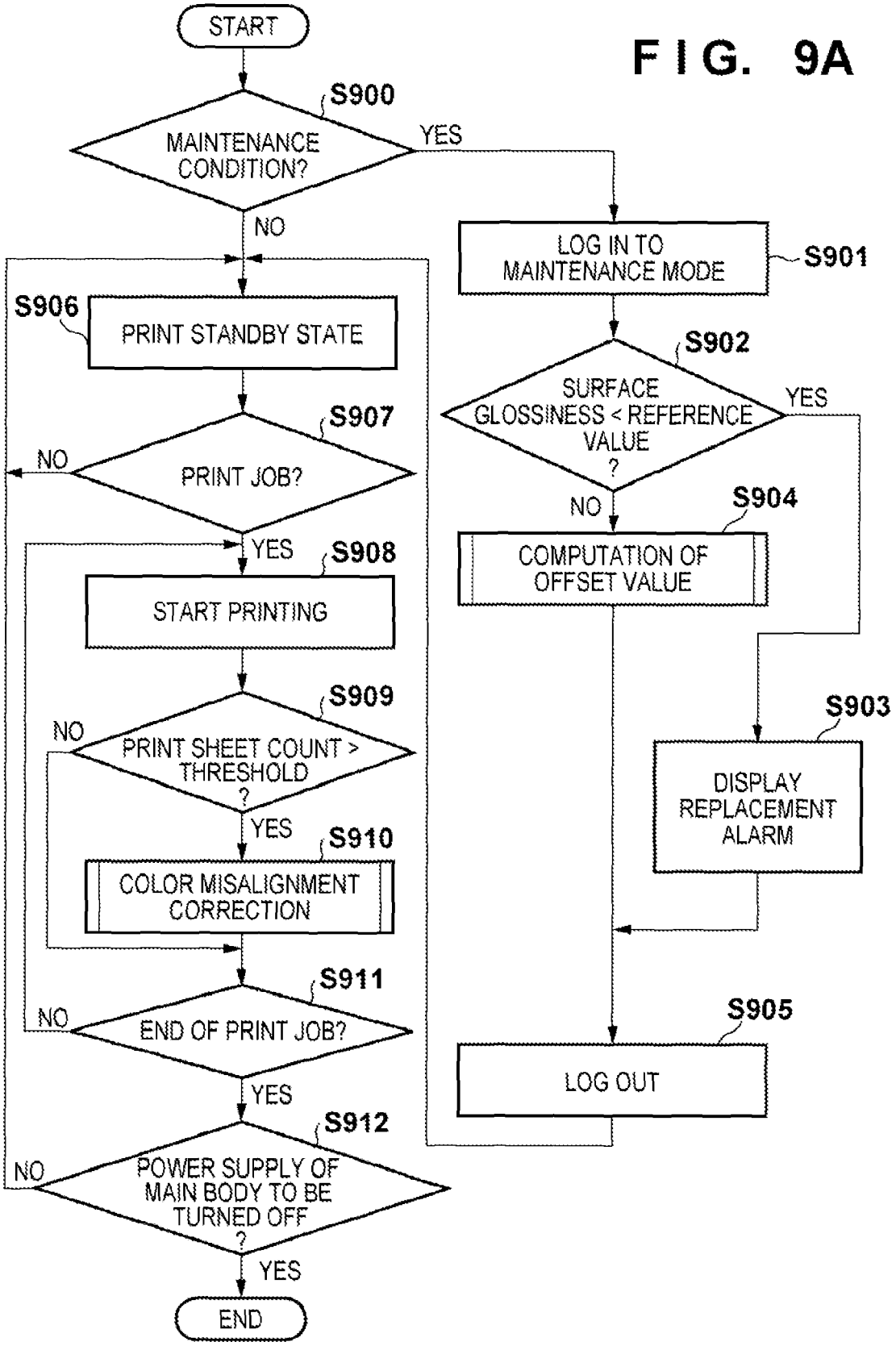
FIG. 9A is a flowchart showing part of color misalignment correction.
Figure 9B:
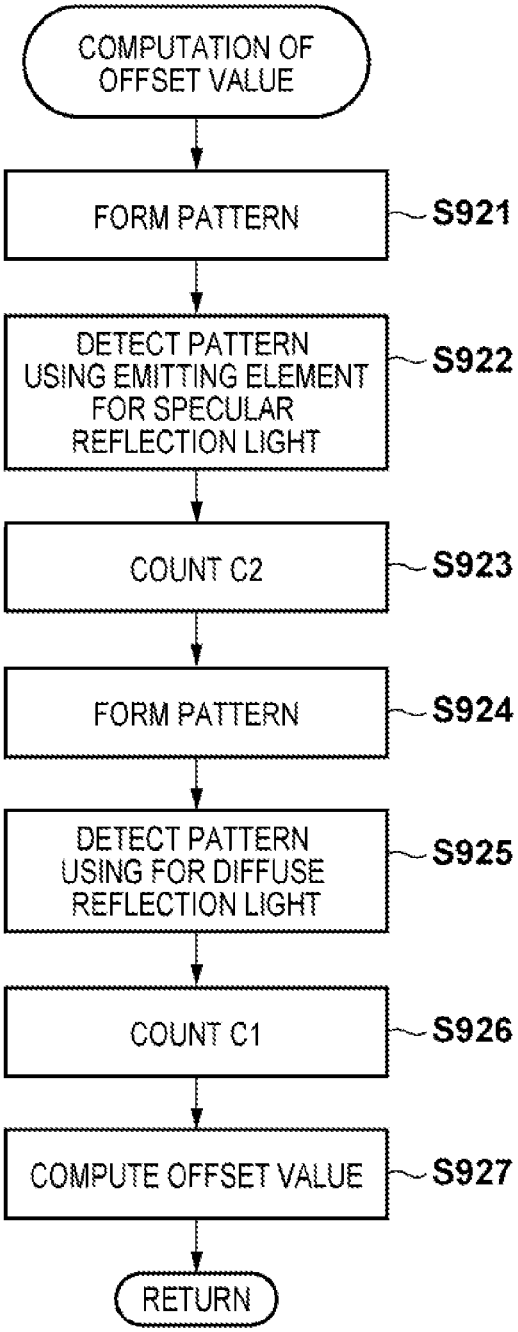
FIGS. 9B and 9C are flowcharts showing the remaining part of color misalignment correction.
Figure 9C:
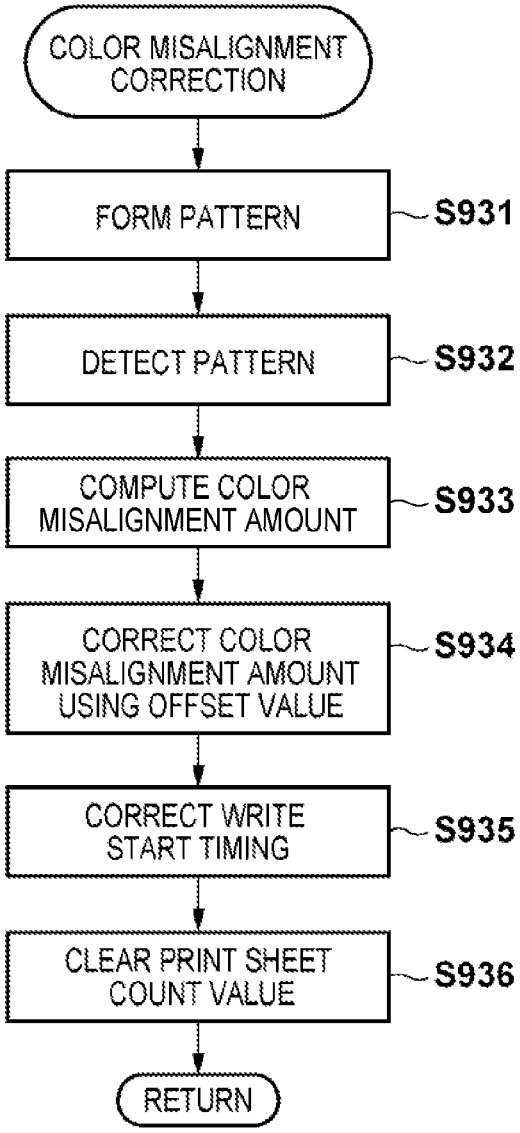

In step S908 of FIG. 9A, the CPU 109 starts the print operation. In step S909, the CPU 109 determines whether the print sheet count value has exceeded a predetermined threshold. In this determination, it is determined whether color misalignment correction is necessary. In general, as the print sheet count increases, color misalignment tends to increase, too. For this reason, the print sheet count is adopted as the color misalignment correction start condition. Assume that the CPU 109 counts print sheets using a counter, and stores the print sheet count in a nonvolatile memory such as an EEPROM. If the print sheet count has exceeded the threshold, the process advances to step S910 to start color misalignment correction. If the print sheet count has not exceeded the threshold, it is estimated that the color misalignment amount is sufficiently small, and the process advances to step S911.

In step S911, the CPU 109 determines whether all images designated by the print job have been formed. If the print job has not ended, the process returns to step S908; if it has ended, advances to step S912. In step S912, the CPU 109 determines whether an instruction has been input from the input device of the operation unit 120 to turn off the power supply of the main body of the image forming apparatus. If no OFF instruction has been input, the process returns to the standby state in step S906. If an OFF instruction has been input, the CPU 109 instructs the power supply device to turn off the power supply of the main body.

The offset value computation operation will be explained in detail with reference to FIG. 9B. Steps S921 to S927 are details of offset value computation processing in step S904. In step S921, the CPU 109 forms the first pattern (detection pattern) for offset detection on the intermediate transfer belt 5 using the pattern generation unit 102. The detection pattern needs to be detected from both specular reflection light and diffuse reflection light. As shown in FIG. 4A, the detection pattern is formed using one of Y, M, and C toner colors. Assume that the detection pattern is formed using a yellow (Y) toner. In this case, the pattern generation unit 102 outputs an image signal corresponding to the detection pattern to the exposure device 15*a*. The exposure device 15*a* emits a laser beam corresponding to the image signal, forming an electrostatic latent image on the photosensitive drum 1*a*. The developing unit 16*a* develops the electrostatic latent image into a toner image. The toner image of the detection pattern is primarily transferred onto the intermediate transfer belt 5, and conveyed to the detection position of the pattern detection sensor 7.

Note that the shape or density of the Y, M, or C detection pattern may be the same as or different from that of a color misalignment correction pattern to be described later. If these patterns are identical, the arrangement of the pattern generation unit 102 can be simplified.

In step S922, the CPU 109 instructs the light source switching unit 111 to turn on the light emitting element for specular reflection 201 a predetermined time after the timing when detection pattern formation has started. The light source switching unit 111 selects the light emitting element for specular reflection 201 and outputs a driving signal. In response to this, the light emitting element for specular reflection 201 is turned on. In accordance with an instruction from the CPU 109, the offset detection unit 107 starts the counter at the timing when detection pattern formation has started. The light receiving element 204 detects specular reflection light from the detection pattern, and outputs an analog output signal corresponding to the quantity of specular reflection light. The threshold control unit 112 sets the first threshold Th1 in the comparator 203 in accordance with an instruction from the CPU 109. The comparator 203 binarizes the analog output signal based on the first threshold Th1, and outputs a digital output signal to the reading control unit 103.

In step S923, the CPU 109 counts the count value C2 from the lighting start timing of the light emitting element for specular reflection 201 to the center position of the pulse by using the offset detection unit 107. First, the offset detection unit 107 reads out an output signal from the reading control unit 103, and determines the center of the pulse of the output signal. Then, the offset detection unit 107 obtains, from the counter, the count value C2 from the lighting start timing of the light emitting element for specular reflection 201 to the center position of the pulse, and saves it.

In step S924, the CPU 109 forms the second pattern (detection pattern) on the intermediate transfer belt 5 using the pattern generation unit 102 in order to detect a detection pattern from diffuse reflection light in the same sequence as that of specular reflection light. For example, when a yellow detection pattern is formed in step S921, a yellow detection pattern is also formed in step S924. In other words, detection patterns are formed on the same image carrier (photosensitive drum 1*a*) in steps S921 and S924, and transferred onto the intermediate transfer belt 5. Of a plurality of image forming units, a single image forming unit forms a pattern for receiving specular reflection light and a pattern for receiving diffuse reflection light, and transfers them onto the intermediate transfer member. The single image forming unit is used in steps S921 and S924 in order to form patterns of the same color in steps S921 and S924.

In step S925, the CPU 109 instructs the light source switching unit 111 to turn on the light emitting element for diffuse reflection light 202 a predetermined time after the timing when detection pattern formation has started. The light source switching unit 111 selects the light emitting element for diffuse reflection light 202 and outputs a driving signal. In response to this, the light emitting element for diffuse reflection light 202 is turned on. In accordance with an instruction from the CPU 109, the offset detection unit 107 starts the counter at the timing when detection pattern formation has started. The light receiving element 204 detects diffuse reflection light from the detection pattern, and outputs an analog output signal corresponding to the quantity of diffuse reflection light. The comparator 203 binarizes the analog output signal based on the first threshold Th1, and outputs a digital output signal to the reading control unit 103. The threshold control unit 112 sets the second threshold Th2 in the comparator 203 in accordance with an instruction from the CPU 109. The comparator 203 binarizes the analog output signal based on the second threshold Th2, and outputs a digital output signal to the reading control unit 103.

In step S926, the CPU 109 counts the count value C1 from the lighting start timing of the light emitting element for diffuse reflection light 202 to the center position of the pulse by using the offset detection unit 107. First, the offset detection unit 107 reads out an output signal from the reading control unit 103, and determines the center of the pulse of the output signal. Then, the offset detection unit 107 obtains, from the counter, the count value C1 from the lighting start timing of the light emitting element for diffuse reflection light 202 to the center position of the pulse, and saves it.

In step S927, the CPU 109 computes a difference between the count values C2 and C1 as the offset value os using the offset detection unit 107, and saves it in the offset detection unit 107.

Color misalignment correction processing will be described in detail with reference to FIG. 9C. Steps S931 to S936 are details of color misalignment correction processing in step S910.

In step S931, the CPU 109 forms a color misalignment correction pattern (correction pattern) on the intermediate transfer belt 5 using the pattern generation unit 102. The correction pattern suffices to be detected from either specular reflection light or diffuse reflection light. As shown in FIG. 4A, the detection pattern is formed in Y, M, C, and K toner colors. In this case, the correction pattern is formed in the order of a black pattern, yellow pattern, magenta pattern, and cyan pattern, in order to obtain the color misalignment amounts of patterns of the remaining colors using the black pattern as a reference.

In step S932, the CPU 109 executes pattern detection. The CPU 109 turns on the light emitting element for specular reflection 201 using the light source switching unit 111. Prior to this, the CPU 109 turns off the light emitting element for diffuse reflection light 202. The CPU 109 sets the first threshold Th1 in the comparator 203 using the threshold control unit 112. After the end of detecting the black pattern, the CPU 109 turns on the light emitting element for diffuse reflection light 202 using the light source switching unit 111. Prior to this, the CPU 109 turns off the light emitting element for specular reflection 201. Then, the CPU 109 sets the second threshold Th2 in the comparator 203 using the threshold control unit 112. An analog output signal corresponding to the black pattern detected from specular reflection light is converted into a digital output signal based on the first threshold Th1. Analog output signals corresponding to the yellow pattern, magenta pattern, and cyan pattern detected from diffuse reflection light are converted into digital output signals based on the second threshold Th2. The digital output signals are stored in the reading control unit 103. In this manner, when detecting a black pattern formed with a black toner out of patterns, the light source switching unit 111 turns on the light emitting element for specular reflection 201 to emit light while turning off the light emitting element for diffuse reflection light 202. When detecting the remaining color patterns formed with the remaining color toners other than black out of patterns, the light source switching unit 111 turns on the light emitting element for diffuse reflection light 202 to emit light while turning off the light emitting element for specular reflection 201.

In step S933, the CPU 109 computes relative color misalignment amounts between the respective colors using the color misalignment computation unit 104. In this case, the distance (time) from the center of the pulse of an output signal corresponding to the black pattern to the center of the pulse of an output signal corresponding to each of the remaining color patterns is computed. This distance corresponds to the relative color misalignment amount of each of the remaining color patterns to the black pattern. The color misalignment computation unit 104 functions as a color misalignment amount computation unit configured to compute the relative color misalignment amounts of the remaining color patterns from the black pattern based on the differences between the detection timing of the black pattern and those of the remaining color patterns by the pattern detection sensor 7.

In step S934, the CPU 109 corrects the color misalignment amount by adding the offset value os to the computed color misalignment amount using the color misalignment correction unit 105. Accordingly, the detection timing shift between specular reflection light and diffuse reflection light arising from optical axis deviation or the like is corrected. The color misalignment correction unit 105 functions as a modification unit configured to modify the color misalignment amount by adding, to the color misalignment amount computed by the color misalignment computation unit 104, the difference between a pattern detection timing by specular reflection light and a pattern detection timing by diffuse reflection light.

In step S935, the CPU 109 corrects Y, M, and C write start timings by adding the corrected color misalignment amounts using the color misalignment correction unit 105. The write start timings are corrected in both the main scanning direction and sub-scanning direction. In the main scanning direction, a write start timing starting from a main scanning sync signal is corrected. In the sub-scanning direction, a write start timing starting from a sub-scanning sync signal is corrected. In this fashion, the color misalignment correction unit 105 functions as a correction unit configured to correct write start timings by adding modified color misalignment amounts to the write start timings of the remaining color patterns. In step S936, the CPU 109 clears the print sheet count value to 0 in order to start color misalignment correction every time the print sheet count exceeds a threshold.

According to the embodiment, the difference (offset value) between a pattern detection timing by specular reflection light and a pattern detection timing by diffuse reflection light can be specified by switching between the light emitting element for specular reflection 201 and light emitting element for diffuse reflection light 202 and also switching between the thresholds to use them. If the offset value is known, the correction pattern detection timing, that is, color misalignment amount can be modified using the offset. Even if the optical axes of a plurality of light emitting units configured to irradiate a correction pattern with light deviate from design values, the color misalignment correction precision hardly decreases.

The embodiment has been described on the premise that a pattern is formed on the intermediate transfer belt 5. However, a pattern may be formed on continuous paper or on a sheet conveyed by the paper conveyance belt. In this case, the arrangement of the pattern detection sensor 7 is changed to a position where the pattern detection sensor 7 can detect continuous paper or a sheet. However, the use of the intermediate transfer belt 5 would be superior to the use of continuous paper or a sheet in terms of the running cost. However, when continuous paper or a sheet is used, a pattern is free from the influence of the gloss of the surface of the intermediate transfer belt 5.

The embodiment has exemplified an image forming apparatus which prints using an electrophotographic process. However, the present invention is not limited to this and is also applicable to, for example, an inkjet printing apparatus. This is because the technical concept of the present invention is applicable to any image forming method which uses printing agents (for example, toners or inks) of a plurality of colors.

As a main feature of the embodiment, the light emitting element for specular reflection 201 and light emitting element for diffuse reflection light 202 alternatively emit light, and a single light receiving element detects patterns. However, the pattern density may be detected. The densities of remaining, yellow, magenta, and cyan color patterns are detected from the quantity of diffuse reflection light based on light emitted by the light emitting element for diffuse reflection light 202. To the contrary, the density of a black pattern is detected from the quantity of specular reflection light based on light emitted by the light emitting element for specular reflection 201.

Figure 7A:
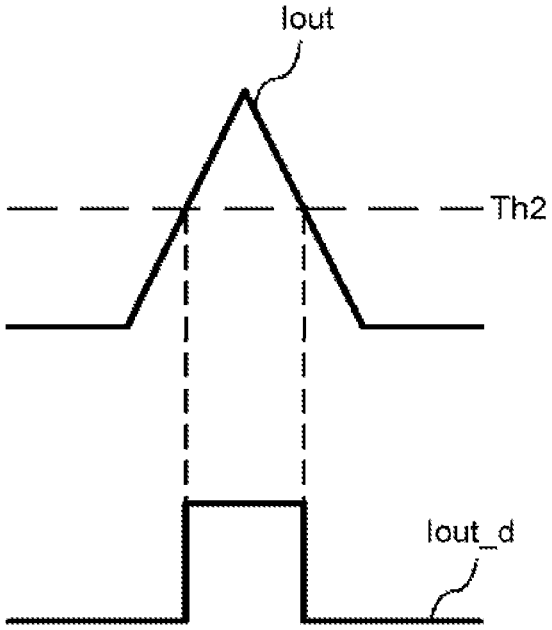
FIG. 7A is a waveform chart showing binarization of specular reflection light.
Figure 7B:
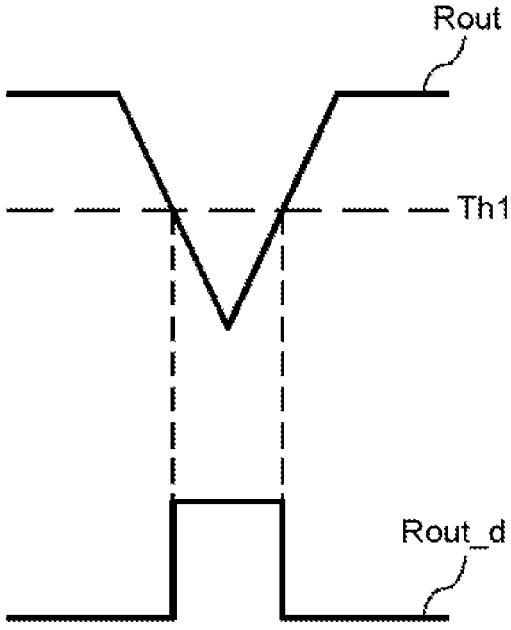
FIG. 7B is a waveform chart showing binarization of diffuse reflection light.

The embodiment has been described on the premise that the light emitting element for specular reflection 201 and light emitting element for diffuse reflection light 202 alternatively emit light, and a signal waveform corresponding to a light quantity detected by the single light receiving element 204 is compared with a given threshold, thereby generating a pulse signal, as shown in FIGS. 7A and 7B. Further, the center position of the pulse signal is computed, and color misalignment correction is performed. However, it is also possible to detect the peak value of an analog signal waveform, generate a pulse signal, and perform color misalignment correction. That is, the position of the peak value is used instead of the above-described center position in offset value computation processing and color misalignment correction processing.

The embodiment has been described on the premise that the surface glossiness of the intermediate transfer belt 5 is detected using the light emitting element for specular reflection 201. However, the surface detection target may be a parameter other than the glossiness as long as this physical parameter allows estimating the degree of wear of the intermediate transfer belt 5. Examples of this parameter are the image formation sheet count and the use time of the intermediate transfer belt 5. In place of the light emitting element for specular reflection 201, the light emitting element for diffuse reflection light 202, another additional light emitting element, and a light receiving element may be employed.

The embodiment has targeted the intermediate transfer belt 5 whose surface glossiness decreases as the intermediate transfer belt 5 wears. However, the present invention is also applicable to an intermediate transfer belt 5 whose surface glossiness increases as the intermediate transfer belt 5 wears, or an intermediate transfer belt 5 whose surface glossiness does not linearly change. In any case, whether to replace the intermediate transfer belt 5 can be determined by measuring the degree of wear.

In the embodiment, the detection timing shift between two light emitting elements is mainly ascribed to optical axis deviation. However, the embodiment is also applicable to a case in which the detection timings of specular reflection light and diffuse reflection light shift as a result of a light emitting element characteristic, circuit characteristic, or the like. This is because when the detection timings of specular reflection light and diffuse reflection light shift from design values, the present invention can detect the shift.

As shown in FIGS. 7A and 7B, each threshold and the duration of a digital output signal (pulse signal) have a close relationship. As the gloss decreases, the level of an analog output signal drops, and the duration of a pulse signal varies. Considering this, it is also possible to read the background or a toner pattern of a predetermined density using specular reflection light and adjust the threshold Th1 by the CPU 109 so that the duration of a pulse signal corresponding to specular reflection light becomes constant. In this manner, the CPU 109 functions as an adjustment unit configured to adjust the first threshold in accordance with the detection result of the light receiving element 204 when the light emitting element for specular reflection 201 emits light. Similarly, it is also possible to read the background or a toner pattern of a predetermined density using diffuse reflection light and adjust the threshold Th2 by the CPU 109 so that the duration of a pulse signal corresponding to diffuse reflection light becomes constant. The CPU 109 functions as an adjustment unit configured to adjust the second threshold in accordance with the detection result of the light receiving element 204 when the light emitting element for diffuse reflection light 202 emits light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-106620, filed May 11, 2011 which is hereby incorporated by reference herein in its entirety.

What is claimed is:

1. An image forming apparatus comprising:

a plurality of image forming units configured to form images of different colors, wherein a predetermined image forming unit of said plurality of image forming units is further configured to form a first pattern and a second pattern on an intermediate transfer member;

a detection unit configured to detect patterns formed by said plurality of image forming units, wherein said detection unit includes:

a light receiving unit, a first light emitting unit located such that said light receiving unit receives specular reflection light, and a second light emitting unit located such that said light receiving unit receives diffuse reflection light;

an emission control unit configured to alternatively control said first light emitting unit and said second light emitting unit to emit light;

a specifying unit configured to specify a difference between an elapsed time until said detection unit detects the first pattern based on light emitted from said first light emitting unit after said first light unit starts lighting, and an elapsed time until said detection unit detects the second pattern based on light emitted from said second light emitting unit after said second light emitting unit starts lighting; and a color misalignment correction unit configured to correct misalignment between color images to be formed by said plurality of image forming units in response to the specified difference and detection results of the patterns formed by said plurality of image forming units, wherein said emission control unit turns on said first light emitting unit a predetermined time after formation of the first pattern starts, and turns on said second light emitting unit the predetermined time after formation of the second pattern starts.

2. The apparatus according to claim 1, further comprising:

a threshold selection unit configured to select and output a first threshold when said first light emitting unit emits light, and select and output a second threshold when said second light emitting unit emits light; and a signal generation unit configured to compare a level of a signal output from said light receiving unit with a threshold selected by said threshold selection unit, and generate a signal serving as a comparison result, wherein said specifying unit is further configured to specify the difference between the elapsed time until said detection unit detects the first pattern based on the light emitted from said first light emitting unit and the elapsed time until said detection unit detects the second pattern based on the light emitted from said second light emitting unit, from a signal generated by said signal generation unit in accordance with a comparison between a level of a signal output when said light receiving unit receives the light emitted from said first light emitting unit and the first threshold, and a signal generated by said signal generation unit in accordance with a comparison between a level of a signal output when said light receiving unit receives the light emitted from said second light emitting unit and the second threshold.

3. The apparatus according to claim 2, further comprising an adjustment unit configured to adjust the first threshold in accordance with a detection result of said light receiving unit when said first light emitting unit emits light.

4. The apparatus according to claim 2, further comprising an adjustment unit configured to adjust the second threshold in accordance with a detection result of said light receiving unit when said second light emitting unit emits light.

5. The apparatus according to claim 1, wherein when a gloss value of a surface of the intermediate transfer member has exceeded a reference value, said specifying unit specifies the elapsed time difference.

6. The apparatus according to claim 1, wherein when detecting a relative color misalignment amount of another color pattern formed with another color toner serving as a toner of a color different from black with respect to a black pattern formed with a black toner after the difference is specified, if said detection unit detects the black pattern, said emission control unit is further configured to turn on said first light emitting unit to emit light and turn off said second light emitting unit, and if said detection unit detects the other color pattern, said emission control unit is further configured to turn on said second light emitting unit to emit light, and turn off said first light emitting unit.

7. The apparatus according to claim 6, wherein said color misalignment correction unit is further configured to:

compute the relative color misalignment amount of the other color pattern with respect to the black pattern from a difference between a detection timing of the black pattern by said detection unit and a detection timing of the other color pattern;

modify the color misalignment amount by adding the difference specified by said specifying unit to the color misalignment amount computed; and correct a write start timing of the other color pattern by adding the modified color misalignment amount to the write start timing.

8. An image forming apparatus comprising:

a plurality of image forming units configured to form images of different colors;

a detection unit configured to detect patterns formed by said plurality of image forming units, wherein said detection unit includes:

a light receiving unit, a first light emitting unit located such that said light receiving unit receives specular reflection light, and a second light emitting unit located such that said light receiving unit receives diffuse reflection light;

an emission control unit configured to alternatively control said first light emitting unit and said second light emitting unit to emit light;

a threshold selection unit configured to select and output a first threshold when said first light emitting unit emits light, and select and output a second threshold when said second light emitting unit emits light;

a signal generation unit configured to compare a level of a signal output from said light receiving unit with a threshold selected by said threshold selection unit, and generate a signal serving as a comparison result;

a specifying unit configured to specify a difference between a detection timing when said detection unit detects a pattern based on light arising from said first light emitting unit, and a detection timing when said detection unit detects a pattern based on light arising from said second light emitting unit by specifying the difference from a signal generated by said signal generation unit in accordance with a comparison between a level of a signal output when said light receiving unit receives the light emitted from said first light emitting unit and the first threshold, and a signal generated by said signal generation unit in accordance with a comparison between a level of a signal output when said light receiving unit receives the light emitted from said second light emitting unit and the second threshold; and a color misalignment correction unit configured to correct misalignment between color images to be formed by said plurality of image forming units in response to the specified difference and detection results of the patterns formed by said plurality of image forming units.

9. An image forming apparatus comprising:

a plurality of image forming units configured to form images of different colors;

a detection unit configured to detect patterns formed by said plurality of image forming units, wherein said detection unit includes:

a light receiving unit, a first light emitting unit located such that said light receiving unit receives specular reflection light, and a second light emitting unit located such that said light receiving unit receives diffuse reflection light;

an emission control unit configured to alternatively control said first light emitting unit and said second light emitting unit to emit light;

a specifying unit configured to specify a difference between a detection timing when said detection unit detects a pattern based on light arising from said first light emitting unit, and a detection timing when said detection unit detects a pattern based on light arising from said second light emitting unit; and a color misalignment correction unit configured to correct misalignment between color images to be formed by said plurality of image forming units in response to the specified difference and detection results of the patterns formed by said plurality of image forming units, wherein when detecting a relative color misalignment amount of another color pattern formed with another color toner serving as a toner of a color different from black with respect to a black pattern formed with a black toner after the difference is specified, if said detection unit detects the black pattern, said emission control unit is further configured to turn on said first light emitting unit to emit light and turn off said second light emitting unit, and if said detection unit detects the other color pattern, said emission control unit is further configured to turn on said second light emitting unit to emit light, and turn off said first light emitting unit.

* * * * *